US005375274A

United States Patent [19]

Cuneo

[11] Patent Number: 5,375,274

[45] Date of Patent: Dec. 27, 1994

[54] BED CLOTHES

[76] Inventor: Margo Cuneo, P.O. Box 308, York, Nebr. 68467

[21] Appl. No.: 109,163

[22] Filed: Aug. 19, 1993

[51] Int. Cl.[5] ..... A47G 9/02; A47G 9/04

[52] U.S. Cl. ..... 5/497; 5/495

[58] Field of Search ..... 5/497, 495, 496, 498, 5/499, 500, 502

[56] References Cited

U.S. PATENT DOCUMENTS

| | | | |
|---|---|---|---|
| 1,865,329 | 6/1932 | McHorter | 5/500 |
| 2,856,615 | 10/1958 | Cirocco | 5/497 |
| 4,035,854 | 7/1977 | Pardee | 5/497 |
| 5,020,177 | 6/1991 | Etherington | 5/496 |

FOREIGN PATENT DOCUMENTS

| | | | |
|---|---|---|---|
| 2219740 | 12/1989 | United Kingdom | 5/497 |

*Primary Examiner*—Alexander Grosz

*Attorney, Agent, or Firm*—Zarley, McKee, Thomte, Voorhees & Sease

[57] ABSTRACT

Bed clothes include a bottom sheet having a pocket formed at the head end and a pocket formed at the rearward end, the pockets sized to snuggly fit the head and foot ends of a mattress. Each pocket is formed with a bottom flap having a width (as measured from the mattress end towards the center of the mattress) greater than the thickness of the mattress, to firmly retain the bottom sheet into position. A top sheet is attached along a foot end to the foot end of the bottom sheet, and along the foot ends of the bottom sheet side panels, with auxiliary foot end portions extending beyond the side panels. The auxiliary foot end portions are attached along the lower edge of the bottom sheet side panels to form a fitted neat appearance for the top sheet.

3 Claims, 2 Drawing Sheets

BED CLOTHES

TECHNICAL FIELD

The present invention relates generally to fitted sheets for mattresses and associated top sheets, and more particularly to an improved fitted bed sheet with end pockets for retaining the sheet in position and an attached top sheet to provide a finished appearance.

BACKGROUND OF THE INVENTION

Fitted sheets for mattresses have long been known as one method for retaining a sheet on a mattress without requiring tedious folding of the corners. Prior art fitted sheets typically come in two main types.

A first type of fitted sheet includes an elastic band attached along the entire peripheral edge of the sheet to draw the sheet closed about the mattress, on the under side of the mattress. However, these elastic bands can wear out, and are not always effective in maintaining the sheet on the mattress.

A second type of fitted sheet utilizes generally triangular shaped panels in each corner of the sheet to form corner Dockets which hold the corners of the mattress. Such corner pockets are more commonly found with waterbed mattresses, wherein the corner of the waterbed may be lifted slightly to permit the mattress to be journaled within the corner pocket. However, corner pockets have also been found to be ineffective in securely maintaining a sheet on the mattress.

In addition, top sheets frequently become loose from under the mattress during use, and are inconvenient to tuck in and refold in making up a bed. For this reason, most waterbed bed clothes utilize a top sheet with a portion of the lower edge attached to a lower end of the fitted sheet. While this method of attaching the top sheet to the fitted sheet eliminates many of the problems associated with loose top sheets, it fails to address the inconvenience of refolding the top sheet at the lower corner to provide a finished appearance.

SUMMARY OF THE INVENTION

It is therefore a general object of the present invention to provide improved bed clothes for a mattress which will maintain a bottom sheet in close fitted relation on the mattress.

Yet another object of the present invention is to provide bed clothes with end pockets for maintaining the bottom sheet on the mattress.

Still another object is to provide bed clothes with a top sheet attached at a lower end to the bottom sheet, in such a way as to provide a neat and finished appearance at all times.

These and other objects of the present invention will be apparent to those skilled in the art.

The bed clothes of the present invention includes a bottom sheet having a pocket formed at the head end and a pocket formed at the rearward end, the pockets sized to snuggly fit the head and foot ends of a mattress. Each pocket is formed with bottom flap having a width (as measured from the mattress and towards the center of the mattress) greater than the thickness of the mattress, to firmly retain the bottom sheet into position. A top sheet is attached along a foot end to the foot end of the bottom sheet, and along the foot ends of the bottom sheet side panels, with auxiliary foot end portions extending beyond the side panels. The auxiliary foot end portions are attached along the lower edge of the bottom sheet side panels to form a fitted neat appearance for the top sheet.

DESCRIPTION OF THE PREFERRED EMBODIMENT

Figure 1:
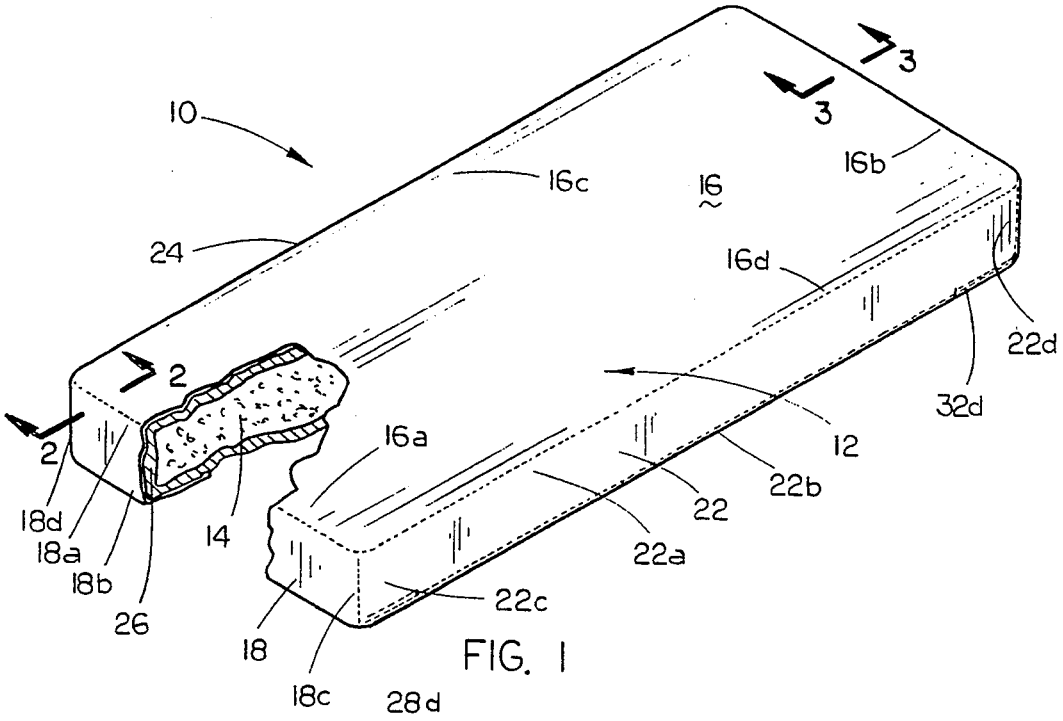
FIG. 1 is perspective view of a mattress with the bottom sheet of the present invention installed thereon, and a portion of the mattress cut away to see the attachment of the sheet the mattress.

Referring now to the drawings, in which similar or corresponding parts are identified with the same reference numeral, and more particularly to FIG. 1, the bed clothes of the present invention are identified generally at 10 and include a bottom sheet 12 installed on a mattress 14.

Bottom sheet 12 is preferably formed of seven separate pieces of material which are connected together to form a single assembly customized to fit a particular mattress with predetermined dimensions. Bottom sheet 12 includes a top panel 16 which matches the dimensions of the top surface of mattress 14, and includes a head end edge **16*a*, a foot end edge 16*b*, and a pair of opposing longitudinal side edges 16*c* and 16*d*. A head end panel 18 is attached to the head end edge 16*a* of top panel 16, and has dimensions which match those of the head end of mattress 14. Head end panel includes an upper edge 18*a* which is continuously attached to top panel edge 16*a* along the entire extent thereof. Head end panel also includes a lower edge and a pair of opposing side edges 18*c* and 18*d***.

Figure 3:
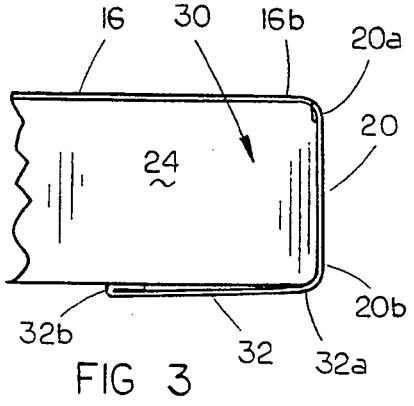
FIG. 3 is a sectional taken at lines 3—3 in FIG. 1.

A foot end panel 20, shown in FIG. 3, is identical to head end panel 18, with an upper edge **20*a* attached along the entire continuous length of foot end edge 16*b* of top panel 16. Foot end panel 20 also includes a lower edge 20*b* and opposing side edges 20*c* and 20*d*** (not shown).

Side panels 22 and 24 are identical, and therefore only side panel 22 will be described in detail. As shown in FIG. 1, side panel 22 matches the dimensions of the side face of the mattress 14. Side panel 22 includes an upper edge **22*a* attached continuously along the length of top panel side edge 16*d*. Side panel 22 also includes a lower edge 22*b* and opposing side edges 22*c* and 22*d*. Side edge 22*c* is connected continuously along its entire length to side edge 18*c* of head end panel 18. Side edge 22*d* is attached in a similar fashion to one side edge of foot end panel 20**.

Figure 2:
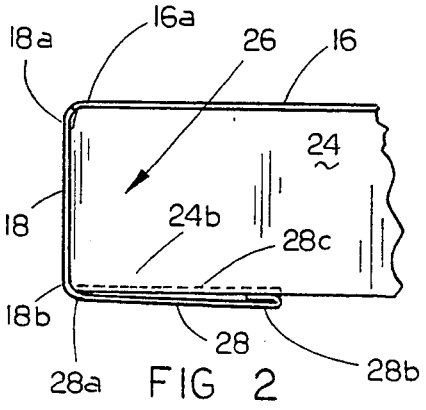
FIG. 2 is a sectional view taken at lines 2—2 in FIG. 1.

As shown in FIGS. 1 and 2, a head end pocket 26 Is formed in the head end of bottom sheet 12 by attaching a rectangular bottom flap 28 to the lower edge **18*b* of head end panel 18. Bottom flap 28 has a forward edge 28*a* which is attached continuously along the entire lower edge 18*b* of end panel 18. Bottom flap 28 extends rearwardly from forward edge 28*a* a distance at least as great as the thickness of the mattress 14, and ends at rearward edge 28***b*. An end edge 28*c* is affixed along the lower edge 24*b* of side panel 24, while the opposing end edge (shown in broken lines in FIG. 1) is affixed along the lower edge 22*b* of side panel 22.

A similar pocket 30 is formed at the foot end of bottom sheet 12, as shown in FIG. 3, utilizing a second rectangular bottom flap 32 attached to the lower edges of end panel 20 and side panels 22 and 24. Bottom flap 32 also extends a distance from end panel lower edge 20*b* at least equal to the thickness of mattress 14, and ends at a rearward edge 32*b*.

As shown in FIGS. 1, 2 and 3, bottom sheet 12 is formed of pieces of an inelastic fabric which are customized to the exact dimensions of the mattress to be covered. The head and foot end pockets 26 and 30, formed along the entire head and foot ends of the mattress securely maintain the bottom sheet 12 in position on the mattress. It has been found that the width of the bottom flaps 28 and 32, as measured from the lower edge of the end flaps, must be equal or greater than the thickness of the mattress in order to maintain the bottom sheet on the mattress. A width less than the thickness of the mattress is subject to slipping off the end of the mattress during normal use.

Figure 4:
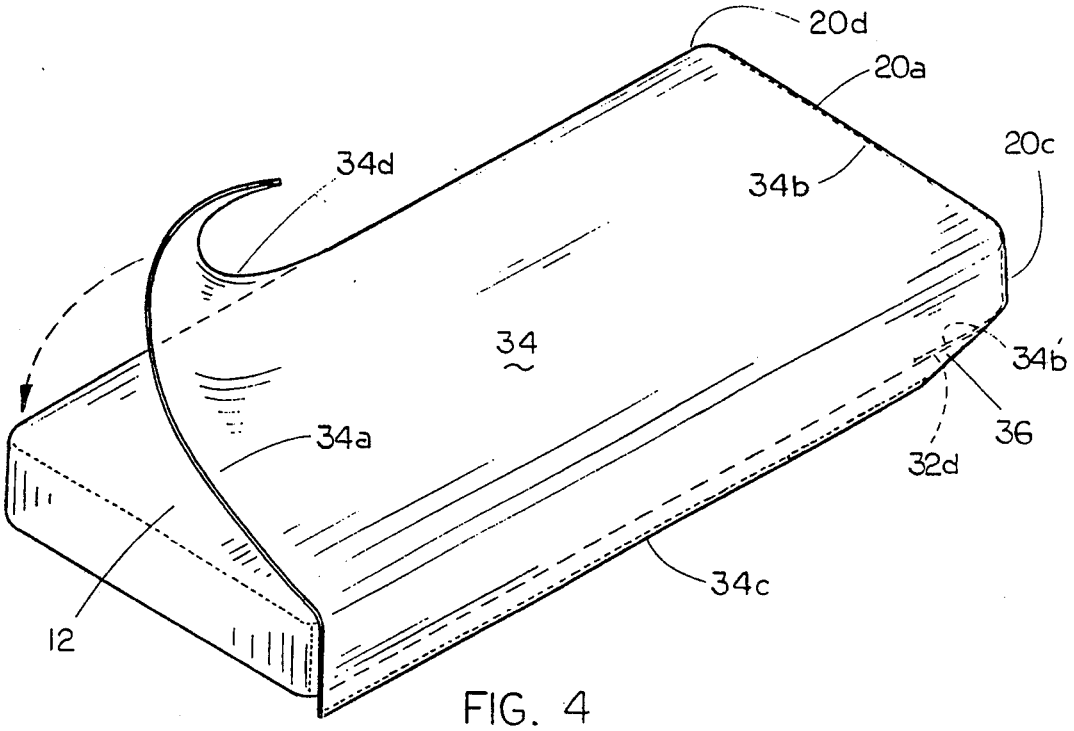
FIG. 4 is a perspective view of the top sheet of the present invention installed on the bottom sheet of the present invention.
Figure 5:
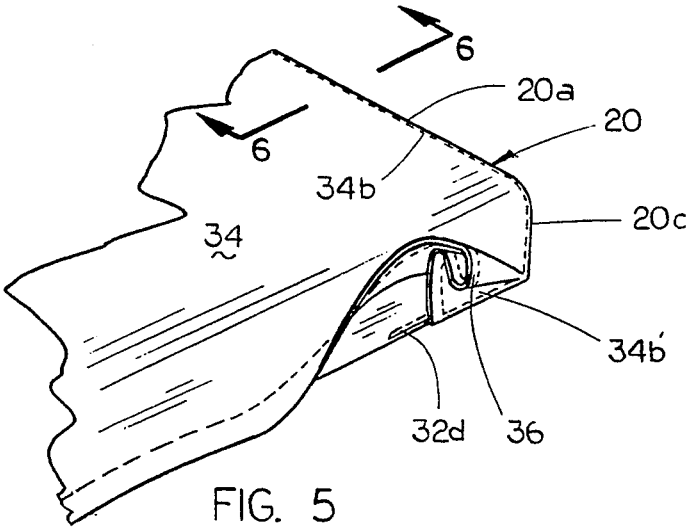
FIG. 5 is a partial perspective view of the connection of the top sheet to the bottom sheet at one corner of the mattress.
Figure 6:
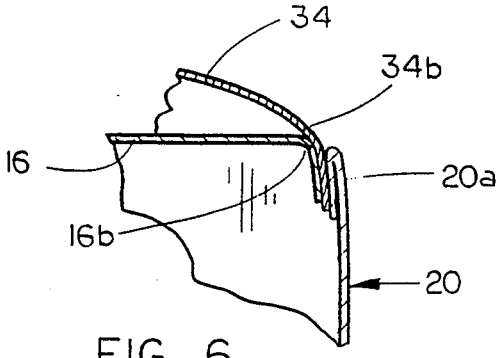
FIG. 6 is a partial sectional view taken at lines 6—6 in FIG. 5.

Referring now to FIGS. 4 and 5, a top sheet 34 includes a head end edge 34*a*, a foot end edge 34*b* and a pair of longitudinal side edges 34*c* and 34*d*. While most waterbed type bed clothes attach the top sheet to the bottom sheet, the connection is made only along the top surface of the mattress which would be associated with only the connection of the upper edge 20*a* of foot end panel 20 with the foot end edge 34*b* of top sheet 34. As shown in FIG. 5, the applicant herein attaches the foot end edge 34*b* continuously along the upper edge 20*a* of foot end panel 20, as well as along both side edges 20*c* and 20*d*. Top sheet 34 has a width great enough to extend downward past the sides of the mattress, so as to provide a portion of foot end edge 34*b*′ which extends beyond side edges 20*c* and 20*d* of foot end panel 20. These projecting portions of foot end edge 34*b*′ are attached along the end edges of the bottom flap 32. As shown in FIG. 5, end portion 34*b*′ is oriented at a right angle so as to form a flap of material 36 when end edge portion 34*b*′ is attached to bottom flap end edge 32*d*. Flap of material 36 forms a smooth finished appearance, as shown in FIG. 4 when the top sheet 34 is pulled over the top of bottom sheet 12. Thus, top sheet 34 is given a closer fitting and more refined appearance than conventional waterbed sheets.

Whereas the invention has been shown and described in connection with the preferred embodiments thereof, it will be understood that many modifications, substitutions and additions may be made which are within the intended broad scope of the appended claims. There has therefore been shown and described improved bed clothes which accomplish at least all of the above stated objects.

I claim:

1. Bed clothes for a mattress having a top surface, a bottom surface, a pair of first and second longitudinal sides, opposing head and foot ends, and a thickness as measured between the top and bottom surfaces, comprising a bottom sheet having a head end pocket formed thereon for receiving the head end of said mattress therein, and a foot end pocket formed thereon for receiving the foot end of said mattress to retain the bottom sheet in position on the mattress, said bottom sheet including:

said head end and foot end pockets being formed of fabric;

a top fabric panel having a head end, foot end, opposing longitudinal side edges, and dimensions substantially the same as the top surface of the mattress;

a head end fabric panel attached continuously along an upper edge to the entire length of the head end of said top panel;

said head end panel including a lower edge, opposing vertical side edges, and having dimensions substantially the same as the head end of the mattress;

a fabric foot end panel attached continuously along an upper edge to the entire length of the foot end of said top panel;

said foot end panel including a lower edge, opposing vertical side edges, and having dimensions substantially the same as the foot end of the mattress;

a fabric first side panel attached continuously along an upper edge to the entire length of the first side edge of the top panel, attached continuously along a first side edge to one side edge of the head end panel, and attached continuously along a second side edge to the entire length of one side edge of the foot end panel, said side panel having a lower edge and dimensions substantially the same as the mattress first longitudinal side;

a second side panel attached continuously along an upper edge to the entire length of the second side edge of said top panel, attached continuously along a first side edge to the second side edge of the head end panel, and attached continuously along a second side edge to the second side edge of the foot end panel;

said second side panel having a lower edge and dimensions substantially the same as the mattress second longitudinal side;

said head end pocket including an inelastic fabric bottom flap having a forward edge attached continuously along the entire length of the head end panel lower edge, a first end attached continuously along its entire length to a portion of said first side panel lower edge, and a second end attached continuously along its entire length to a portion of said second side panel lower edge, and having a rearward edge;

said head end pocket bottom flap having a length, as measured from the forward edge to the rearward edge, at least as great as the thickness of the mattress;

said foot end pocket including an inelastic fabric bottom flap having a forward edge attached continuously along the foot end panel lower edge, a first end attached continuously along a portion of said first side panel lower edge, and a second end attached continuously along a portion of said second side panel lower edge, and having a rearward end;

said foot end pocket bottom flap having a length, as measured from the forward edge to the rearward edge, at least as great as the thickness of the mattress;

said bed clothes further comprising:

a top sheet having a head end, a foot end, and opposing side edges, attached along a portion of the foot end to the entire length of said bottom sheet top panel foot end, along the entire length of said first side panel second side edge, and along the entire length of said second side panel second side edge;

said top sheet having a width, as measured from side edge to side edge, greater than the width of the mattress top surface added to twice the mattress thickness, to form first and second auxiliary foot end edges extending beyond the attachment of the top sheet to the bottom sheet.

2. The bed clothes of claim 1, wherein the first auxiliary foot end edge is attached along its entire length to the bottom sheet first side panel lower edge, and wherein the second auxiliary foot end edge is attached along its entire length to the bottom sheet second side panel lower edge.

3. A sheet for a mattress having a top surface, a bottom surface, a pair of first and second longitudinal sides, opposing head and foot ends, and a thickness as measured between the top and bottom surfaces, comprising:

an inelastic top fabric panel having a head end, foot end, opposing longitudinal side edges, and dimensions substantially the same as the top surface of the mattress;

an inelastic head end fabric panel attached continuously along an upper edge to the entire length of the head end of said top panel;

said head end panel including a lower edge, opposing vertical side edges, and having dimensions substantially the same as the head end of the mattress;

an inelastic foot end fabric panel attached continuously along an upper edge to the entire length of the foot end of said top panel;

said foot end panel including a lower edge, opposing vertical side edges, and having dimensions substantially the same as the foot end of the mattress;

an inelastic fabric first side panel attached continuously along an upper edge to the entire length of the first side edge of the top panel, attached continuously along a first side edge to one side edge of the head end panel, and attached continuously along a second side edge to the entire length of one side edge of the foot end panel, said side panel having a lower edge and a height, as measured from the upper edge to the lower edge, no greater than the thickness of the mattress;

an inelastic second side panel attached continuously along an upper edge to the entire length of the second side edge of said top panel, attached continuously along a first side edge to the second side edge of the head end panel, and attached continuously along a second side edge to the second side edge of the foot end panel;

said second side panel having a lower edge and a height, as measured from the upper edge to the lower edge, no greater than the thickness of the mattress;

an inelastic rectangular, fabric head end bottom flap having a forward edge attached continuously along the entire length of the head end panel lower edge, a first end attached continuously along its entire length to a portion of said first side panel lower edge, and a second end attached continuously along its entire length to a portion of said second side panel lower edge, and having a rearward edge, forming a head end pocket for receiving the head end of the mattress;

said head end bottom flap having a length, as measured from the forward edge to the rearward edge, at least as great as the thickness of the mattress;

an inelastic, rectangular fabric, foot end bottom flap having a forward edge attached continuously along the foot end panel lower edge, a first end attached continuously along a portion of said first side panel lower edge, and a second end attached continuously along a portion of said second side panel lower edge, and having a rearward edge, forming a foot end pocket for receiving the foot end of the mattress;

said foot end pocket bottom flap having a length, as measured from the forward edge to the rearward edge, at least as great as the thickness of the mattress, the combined length of the head and bottom flap and foot end bottom flap being substantially smaller than the length of the mattress, whereby upon positioning of the sheet upon the mattress a substantial portion of the mattress bottom surface between the lower edges of the side panels and the rearward edges of the head end bottom flap and the foot end bottom flap are left uncovered by the sheet.

* * * * *